US005161463A

United States Patent [19]

Knauer et al.

[11] Patent Number: 5,161,463

[45] Date of Patent: Nov. 10, 1992

[54] PRINTING SYSTEM WITH FLYING-PLATE CHANGE

[75] Inventors: Peter Knauer, Münster/Lech; Josef Singler, Höchstädt, both of Fed. Rep. of Germany

[73] Assignee: Man Roland Druckmaschinen AG, Offenbach am Main, Fed. Rep. of Germany

[21] Appl. No.: 815,131

[22] Filed: Dec. 27, 1991

[30] Foreign Application Priority Data

Feb. 7, 1991 [DE] Fed. Rep. of Germany ..... 4103744

[51] Int. Cl.[5] ..... B41F 5/04

[52] U.S. Cl. ..... 101/220; 101/247; 101/352

[58] Field of Search ..... 101/220, 218, 177–179, 101/180–182, 216, 247, 352

[56] References Cited

U.S. PATENT DOCUMENTS

| | | | |
|---|---|---|---|
| 1,306,726 | 6/1919 | Smith | 101/220 |
| 3,323,452 | 6/1967 | Pasquinelli | 101/218 |
| 3,329,086 | 7/1967 | Pullen | 101/177 |
| 3,470,816 | 10/1969 | Piecha et al. | 101/216 |
| 3,817,174 | 6/1974 | Paulson | 101/247 |
| 4,183,297 | 1/1980 | Suiers | 101/218 |
| 4,301,728 | 11/1981 | Jaffe et al. | 101/220 |
| 4,526,099 | 7/1988 | Niemiro et al. | 101/220 |
| 4,815,377 | 3/1989 | Skiera | 101/218 |

FOREIGN PATENT DOCUMENTS 3917340 11/1990 Fed. Rep. of Germany .

*Primary Examiner*—Eugene H. Eickholt

*Attorney, Agent, or Firm*—Frishauf, Holtz, Goodman & Woodward

[57] ABSTRACT

To positively lock in position a pair of eccentrically journalled blanket cylinders (3, 6), movable between three positions, namely in engagement with a first pair of plate cylinders (1, 4), or a second pair of plate cylinders (2, 5), or in engagement with neither plate cylinder, the blanket cylinders having a printing substrate passed therebetween for perfecting printing, the eccentric bearings (7, 8) for the blanket cylinders are secured to operating disks (9, 10) which, each, are coupled to a scissor-link arrangement formed by two pairs of links (16, 18; 17, 19), joined at a common pivot point. Pneumatic cylinder-piston arrangements move the pivot points (1618, 1719) to compress one of the scissor link pairs to V position, while the other link pair is moved to slightly over-center in-line position for a toggle or locking effect; when both scissor link arms are in half-open V position, the blanket cylinders are disengaged from the plate cylinders. Abutment stop means, located between the blanket cylinders, receive the pivot points, when the link arms are in essentially in-line or toggle position, and adjustment bolts (42, 43, 44, 45) can control the position of the scissor link arms, when in V position for accurate adjustment of the locked position of the blanket cylinders.

14 Claims, 4 Drawing Sheets

PRINTING SYSTEM WITH FLYING-PLATE CHANGE

Reference to related application, assigned to the assignee of the present application: U.S. patent application Ser. No. 07/706,883, filed May 29, 1991, Knauer et al. Reference to related patent disclosure: German Patent Disclosure Document 39 17 340 Al, Fausel.

FIELD OF THE INVENTION

The present invention relates to offset printing machines, and more particularly to an offset printing machine capable of double-sided or perfecting printing and permitting flying-plate change.

BACKGROUND

Various flying-plate change printing machines are known, in which alternately used plate cylinders are provided, selectively engageable with an offset or blanket cylinder. The referenced application, assigned to the assignee of the present invention, U.S. patent application Ser. No. 07/706,883, filed May 29, 1991, Knauer et al, describes such a machine, which is suitable for perfecting printing, and in which the plate cylinders are retained in fixed axial position within the printing machine, and the blanket cylinders are, selectively, engageable, with either one of a pair of plate cylinders, so that the other pair of plate cylinders can have their plates changed, or with neither one of the plate cylinders. The bearings for the rubber blanket cylinders, thus, are so constructed that they may have three positions two print-ON positions for engagement with the respective plate cylinder pair, and a throw-OFF position.

The position change of the blanket cylinders, in accordance with the disclosure of the applification, utilizes pneumatic positioning apparatus which engage on eccentric bearings. Customarily, the pneumatic positioning apparatus includes pneumatic cylinder-piston units which are coupled by suitable links to the eccenter bearing, to shift the position of the eccentric bearing and thus appropriately positioning the blanket cylinder, retained within the bearing.

It has been found that, during printing operation, the blanket cylinders engaged with the plate cylinders are subjected to oscillating forces which are transferred via the linkage to the air cushion of the pneumatic piston-cylinder unit. This feedback causes a variation in the engagement pressure of the rubber blanket cylinder with the respective plate cylinder; a uniform engagement pressure, thus, is not ensured.

THE INVENTION

It is an object to further improve a printing system of this type in which the rubber blanket cylinder can be shifted between two print-ON positions and a throw-OFF position and which, in spite of this adjustability of the rotary retention of the rubber blanket cylinder, the engagement pressure of the blanket cylinder with the associated plate cylinder or plate cylinder pair remains uniform and even, and in spite of dynamic forces which may arise in operation of the printing machine.

Briefly, the shifting arrangement includes two pairs of double links; each pair of the double links have a common pivot, so that they can operate in scissor-like fashion. They face each other; when either one of the plate cylinders is in the print-ON position, one of the double-link scissor is in V position, whereas the other one is stretched, just beyond an in-line or straight-line position, so that it will be securely retained in form of a toggle; to change the plate cylinders, the scissors are moved by a piston and cylinder arrangement to reverse the respective V configuration and the over-center in-line configuration. If both blanket cylinders are in the throw-OFF position, both of the link systems will be in V configuration, but at a wider angle than either link system would have if one of the plate cylinder pairs is ON.

In accordance with a feature of the invention, abutment and stop means are provided, positioned for operative association with each pair of the double links, to be engaged by that one of the double links which is in V configuration so that, in effect, the eccentric bearing is clamped in reliably held position between the links which are over-center in-line and the V-configured links engaged against the abutment or stop arrangement.

The abutment or stop arrangement limits the closing or converging movement of the link pairs and defines a closed position. They are disengaged from the links when the blanket cylinders are in the throw-OFF position. Since this is not a printing position, the vibration-free retention of the eccenter bearing is not important.

DRAWINGS

DETAILED DESCRIPTION

Figure 1:
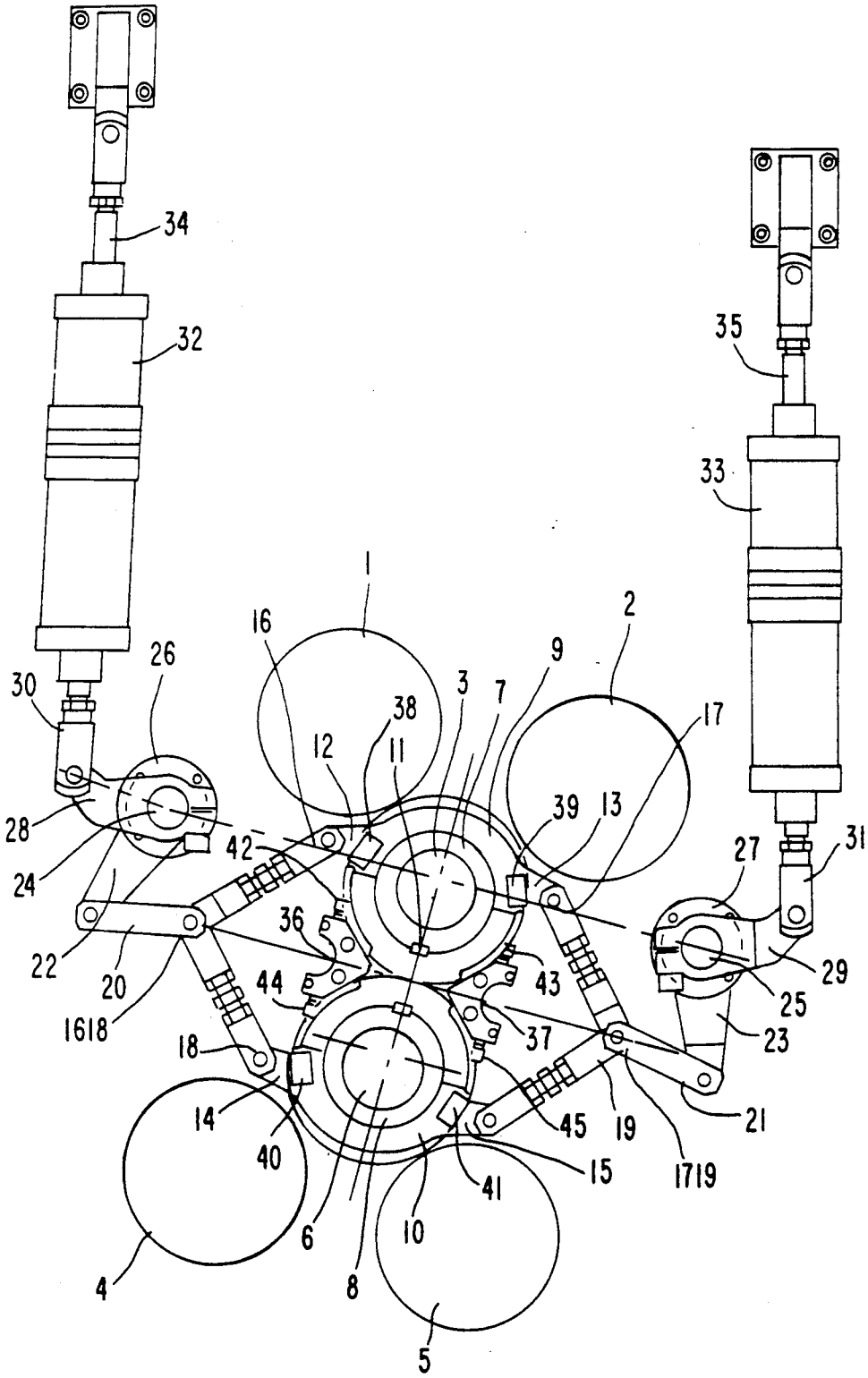
FIG. 1 is a highly schematic side view of a printing unit in which two blanket cylinders are positioned in a throw-OFF position, that is, disengaged from the associated plate cylinder pairs.

FIG. 1 illustrates a printing system for prime and verso or perfecting printing; it has two plate cylinders 1, 2, associated with a blanket cylinder 3. Two further plate cylinders 4, 5 are associated with a second blanket cylinder 6. The plate cylinders 1, 4 and 2, 5 form pairs; they are retained in the side walls or frame of the printing machine, shown only in fragmentary view at 46 in FIG. 4. The axes of rotation of the plate cylinders 1, 2, 4, 5 are fixed. The two blanket cylinders 3, 6 are retained in the side walls of the printing machine, as well known, by eccentric bearings, shown in FIGS. 1 to 3 at 7 and 8. The blanket cylinders 3 and 6 are so arranged that a printing web, shown only schematically, can be passed between the blanket cylinders, for perfecting printing.

The eccenter bearings 7, 8 each have a ring disk 9 and 10 respectively secured thereto for rotation therewith. The ring disks 9, 10 are geared in a range 11, where they face each other.

Each disk 9, 10 has radially extending projections 12, 13 and 14, 15. Each radial projection has a link or lever element 16, 17, 18, 19 pivotably attached thereto. Links 16, 18 are joined at pivot 1618; links 17, 19 are joined at pivot 1719. These links 16 and 18, together, form a double lever which can move in a scissor-like manner between a closed V arrangement and open so that the links will be, effectively, in an in-line position; they can pivot backwardly slightly, so that a toggle effect is obtained. The same arrangement is possible for the links 17, 19. The projections 12, 13 and 14, 15 on the disks 9, 10 are so arranged, in space, that opening of the scissor links 16, 18 causes closing of the scissor links 17, 19.

The common pivot points 1618 and 1719 are coupled to respective link elements 20, 21 which, in turn, are pivotably coupled to link arms 22, 23. The link arms 22, 23 are fixed on shafts 24, 25 for rotation therewith, secured in the side walls of the machine by suitable bearings or holders 26,27. A further link arm 28, 29 is coupled to the shafts 24, 25, to rotate therewith, and, in turn, is pivoted to respective piston rods 30, 31 of cylinder-piston units 32, 33. The piston cylinder units 32, 33 have a second piston rod, each, namely rods 34, 35 extending from the remote side of the cylinders 32, 33, which piston rods 34, 35 are suitably secured to a side wall of the machine. By suitable pressurizing of the cylinder and hence of the piston, each one of the piston cylinder arrangements 32, 33 can be controlled for projection in three different lengths.

In accordance with a feature of the invention, each one of the scissor links 16, 18 and 17, 19, respectively, is associated with U-shaped stop or abutment elements 36, 37, located adjacent the disks 9, 10. The arrangement is so made and the stops or abutments are so secured to the side walls of the machine that the pivots 1618 and 1719, respectively, can be fitted into the recess formed by the U-shaped stops 36, 37, for engagement therein.

Projections 38, 39, 40, 41 are located on the disks 9, 10 in the region of the projections 12, 13 and 14, 15. Adjustable bolts 42, 43, 44, 45 are screwed into the legs of the U-shaped stops or abutments, to extend outwardly therefrom at opposite sides. This permits adjustment of the limit of travel of the projections 38, 39 and 40, 41, and hence limiting the eccentric movement of the eccenter bearings for the cylinders 3, 6.

Figure 4:
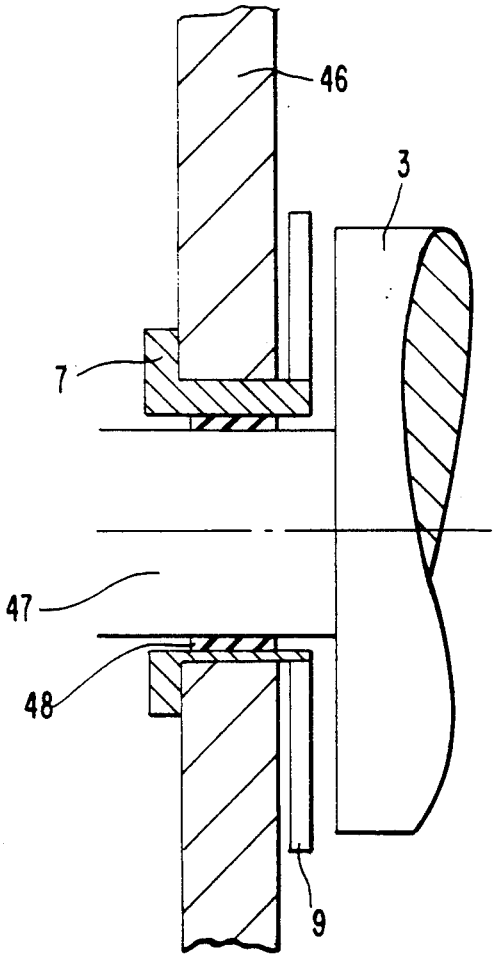
FIG. 4 is a highly schematic cross-sectional view through an eccenter bearing, omitting all elements not necessary for an understanding of the present invention.

FIG. 4 illustrates one bearing of the blanket cylinder 3. The blanket cylinder 3 has a bearing stub or pin 47 which is located within an eccenter bearing 7. The eccenter bearing 7 is a ball or roller bearing 48, directly retaining the shaft 47 for rotation therein. The outer race of the bearing 7 is eccentric with respect to the center line of the shaft 47 and located between the side wall 46 and the end face of the blanket cylinder 3. The disk 9 is located between the side wall 46 and the end face of the cylinder 3, and secured to the bearing 7 so that, upon shifting the disk 9, the eccentric position of the bearing 7 with respect to the side wall will vary and thus shift the axis of rotation of the cylinder 3 with respect to the side wall.

Figure 2:
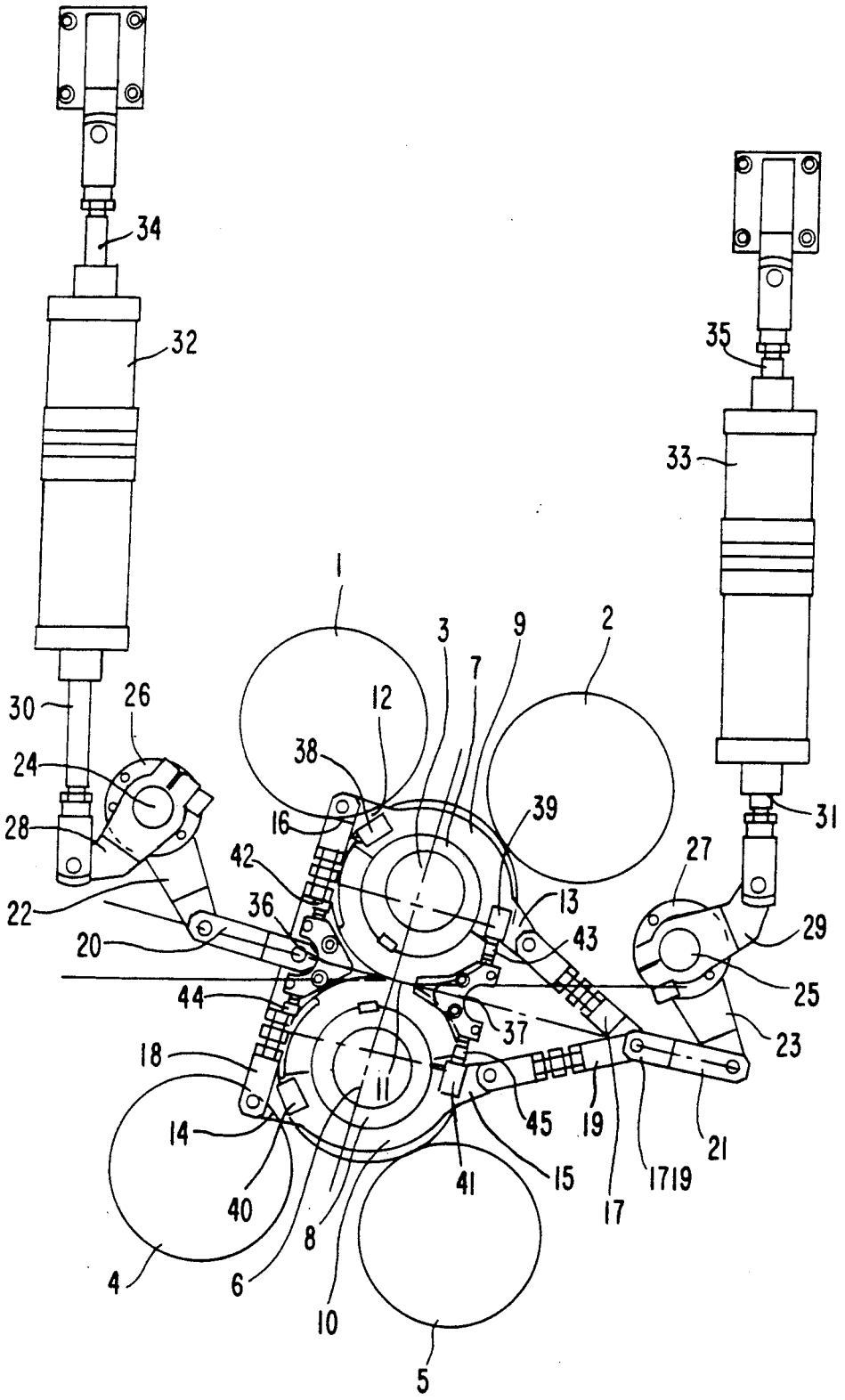
FIG. 2 is a view similar to FIG. 1 in which two plate cylinder pairs are in engagement with the blanket cylinder pairs in a print-ON position.
Figure 3:
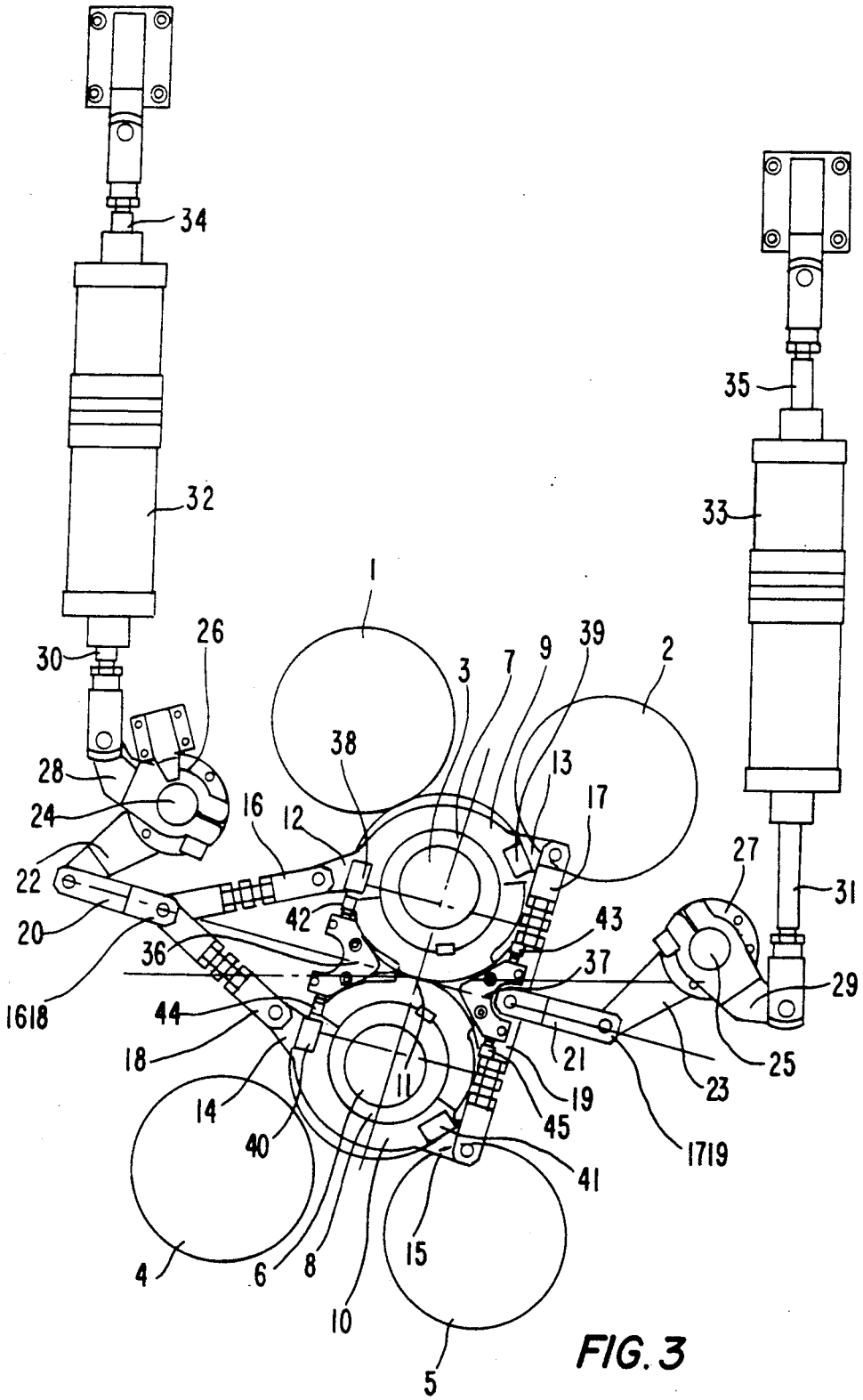
FIG. 3 is a view similar to FIG. 2 in which another plate cylinder pair is in engagement with the blanket cylinder pair in a print-ON position.

FIGS. 1, 2 and 3 illustrate the positioning arrangement and the stop or abutment system for positioning and locking the blanket cylinders 3 and 6 in position only on one side of the blanket cylinders 3, 6. Similar arrangements are located at the other facing side of the blanket cylinder, and synchronized with each other by the shafts 24, 25, which extend axially across the machine, parallel to the respective cylinders. By this arrangement, only two pneumatic cylinder-piston units 32, 33 need be provided.

The gearing in the region 11 of the disks 9, 10 synchronizes the movement of the two blanket cylinders 3, 6.

Operation:

Let it be assumed that the plate cylinder pair 1, 4 is to print, that is, must be engaged with the blanket cylinders 3, 6, as illustrated in FIG. 3. The cylinder-piston units 32, 33 are so controlled that the unit 32 is completely retracted whereas the unit 33 is completely expanded. This moves the scissors 16, 18 and 17, 19 in respectively opposite directions. The movement of the cylinders 32 and 33, and of the associated cylinder links, thus, is phase-shifted by 180°.

The links 17,19 are pushed from the position shown in FIG. 1 to the position shown in FIG. 3, whereas the links 16, 18 are pulled in the opposite direction. The push of the links 17–19 extends over an in-line or 180° alignment of the links 17 and 19, so that the links will have a slight over-center position and, consequently, operate like a locking toggle. The operation could also be such that only the cylinder 32 pulls the links 16, 18 to the left, in FIG. 3, so that the links 16, 18 are pulled by the pivot 1618 to close scissor links 16, 18. This presses at the same time the link elements 17, 19 beyond the dead-center position and into an over-center or toggle position. The projections 38, 40 will engage the bolts 42, 44 of the U-shaped stop or abutment element 36. This positively fixes the position of the blanket cylinders 3, 6 by engagement of the adjustable bolts 42, 44 against the projections 38, 40 and the toggle effect of the links 17 and 19.

The locked position can be accurately adjusted by the adjustable bolts 42, 44. If the bolts 42, 44 are slightly screwed out, the lever elements 17-19 can be somewhat shortened. This permits fine adjustment of the position of the blanket cylinders 3, 6 with respect to the plate cylinders 1,4 and 2, 5, respectively. The plates can now be changed on the plate cylinders 2, 5, while the cylinders 1, 4 print. When the plates on cylinders 1, 4 are to be changed, it is only necessary to reverse the above-described sequence, that is, to retract the cylinder-piston arrangement 33, and place the apparatus in the position shown in FIG. 2, in which, then, the plate cylinders 2, 5 will be in engagement with the blanket cylinders 3, 6, and plates can be changed on the plate cylinders 1, 4, while the machine continues in operation.

The links 16, 17, 18, 19, respectively, are lengthadjustable, for example by a center-mounted bolt, similar to a turnbuckle arrangement, as well known, and as shown schematically in FIGS. 1–3. The locking of the plate cylinders, thus, can be readily and accurately adjusted.

Various changes and modifications may be made, and any features described herein may be used with any of the others within the concept of the present invention.

We claim:

1. Offset printing system for double-sided or perfecting printing having a machine frame (46);

a first pair of plate cylinders (1, 4);

a second pair of plate cylinders (2, 5), said plate cylinders being positioned in the machine frame in axially fixed and predetermined positions with respect to each other;

two blanket cylinders (3, 6) positioned for having a predetermined substrate passed therebetween;

eccentric bearing means (7, 8) retaining the blanket cylinders in the machine frame (46) with their axes of rotation eccentrically movable between three positions which place the blanket cylinders, selectively, in engagement with the first pair of plate cylinders (1, 4), or the second pair of plate cylinders (2, 5) to receive a printing image from the respectively engaged plate cylinder pair, or neither plate cylinder; and means for shifting the eccentric bearing means (7, 8) to thereby shift the axes of rotation of the blanket cylinders (3, 6) between said three positions, said shifting means comprising, in accordance with the invention, two pairs of double links (16, 18; 17, 19);

a common pivot (1618; 1719) coupling one end of each link of each pair, whereby said links of each pair will form a scissor arrangement, the double links being movable between a V-angle configuration and a centered in-line configuration and an overcenter, shallow V configuration, the other ends of each link of the pairs being coupled to a respective one of said bearing means for shifting said bearing means between said three positions; and abutment and stop means (36, 37),each positioned for operative association with each pair of double links to engage said double links of one pair (FIG. 2: 17, 19) when the links of the other pair (16, 18) have spread beyond a dead-center position and in which said dead-center position the links of the other pair are just beyond a straight line alignment with each other, and the scissor arrangement is open to just over 180°, said abutment and stop means (36, 37) limiting the closing or converging movement of the links of said one pair (17, 19) and defining a closed position in which the links are facing each other in V configuration.

2. The system of claim 1, further including a cylinder-piston operating system (32, 30, 34; 33, 31, 35) associated with each pair of double links; and a linkage system (20, 22, 24, 26, 28; 21, 23, 25, 27, 29) coupled to the respective common pivots (1618; 1719) and to the associated cylinder-piston system for moving said double links between V and in-line positions.

3. The system of claim 2, wherein said cylinder-piston arrangement comprises a pneumatic system.

4. The system of claim 2, wherein said cylinder-piston arrangement comprises two individually pressurizable cylinder units (32, 33) having, respectively, two pistons and piston rods (30,34; 31, 35) extending from opposite ends of the cylinder, and permitting length-adjustment of the cylinder-piston units in three different lengths.

5. The system of claim 1, wherein the abutment and stop means comprises U-shaped elements (36, 37) having leg portions facing said double links (16, 18; 17, 19).

6. The system of claim 5, wherein said U-shaped abutment or stop means (36, 37) is formed with a central depressed portion which matches, at least approximately, the common pivot (16, 18; 17, 19) for seating therein when the double links of the seated pivot are in essentially in-line 180° position.

7. The system of claim 5, wherein said abutment and stop means (36, 37) include adjustable elements (42, 43, 44, 45),secured to the legs of the U-shaped abutment and stop means (36, 37).

8. The system of claim 1, wherein said adjustable elements comprise screw bolts (42, 43, 44, 45) extending laterally from the legs of the V-shaped abutment and stop means (36, 37).

9. The system of claim 1, further including bearing adjustment disks (9, 10) secured to the eccentric bearing means (7, 8);

and wherein the other ends of each of the links of the pairs are secured to said bearing adjustment disks.

10. The system of claim 9, further including abutment blocks (38, 40; 39, 41) located on said bearing adjustment disks, said abutment blocks being engageable with said abutment and stop means (36, 37).

11. The system of claim 8, further including abutment blocks (38, 40; 39, 41) located on said bearing adjustment disks, said abutment blocks being engageable with said abutment and stop means (36, 37);

and wherein said adjustable bolts (42, 44; 43, 45) are engageable with said abutment blocks.

12. The system of claim 9, wherein said bearing adjustment disks (9, 10) are located between the side wall (46) and the facing side of the associated blanket cylinder (3, 6).

13. The system of claim 2, further including a pivot shaft (24, 25) secured to the frame of the machine;

a first link arm (22, 23) coupled to the pivot shaft (24, 25);

a second link arm (20, 21) pivoted to an end of said first link arm remote from the pivot shaft (24, 25) and further pivoted to said common pivot (16, 18, 17, 19);

bearing means (26, 27 ) for said pivot shaft;

and a third link element (28, 29) secured to said pivot shaft and coupled to a piston rod (30, 31) of the respective piston-cylinder arrangement (32, 33).

14. The system of claim 13, wherein said pivot shaft (24, 25) extends parallel to the respective cylinders axially across the printing machine; and wherein said printing machine includes additional eccentric bearing means, two pairs of double links coupled by a common pivot, and first and second link arms, all located adjacent a second side wall of the printing machine at a remote axial end of said cylinders.

* * * * *